US006606950B1

(12) United States Patent
Putman

(10) Patent No.: US 6,606,950 B1
(45) Date of Patent: Aug. 19, 2003

(54) METHOD AND APPARATUS FOR POSITIONING A SHAPED CHARGE

(76) Inventor: Charles Ray Putman, P.O. Box 2020, Mills, WY (US) 82644

( * ) Notice: Subject to any disclaimer, the term of this patent is extended or adjusted under 35 U.S.C. 154(b) by 7 days.

(21) Appl. No.: 09/912,210

(22) Filed: Jul. 24, 2001

(51) Int. Cl.[7] ..... F42B 1/024; E21B 43/118

(52) U.S. Cl. ..... 102/306; 102/307; 102/343; 102/344; 102/358; 102/476

(58) Field of Search ..... 102/306, 307, 102/343, 344, 358, 476

(56) References Cited

U.S. PATENT DOCUMENTS 1,409,108 A * 3/1922 Hill ..... 102/306
1,430,959 A * 10/1922 Dutcher ..... 102/344
2,849,953 A * 9/1958 Delacour ..... 102/306
3,117,518 A * 1/1964 Porter et al. ..... 86/50 X
3,561,703 A * 2/1971 Stencel ..... 102/306 X
3,718,512 A * 2/1973 Hurst ..... 102/306 X
3,739,731 A * 6/1973 Tabor ..... 86/50 X
4,220,687 A * 9/1980 Christopher ..... 102/306 X
4,850,277 A 7/1989 Hogstrom
4,917,015 A * 4/1990 Lowery ..... 102/344 X
5,353,709 A * 10/1994 Emmenegger et al. .. 102/307 X

* cited by examiner

*Primary Examiner*—Peter A. Nelson
(74) *Attorney, Agent, or Firm*—Gibson, Dunn & Crutcher LLP; Stanley J. Gradisar

(57) ABSTRACT

A method and apparatus for positioning a shaped charge for destroying land mines and unexploded ordnance utilizes one or more pins secured to a shaped charge. In one embodiment, an outer body made of molded rubber has one or more flanges with holes for receiving the pins. By manipulating the legs of the pins, the shaped charge is positioned in proximity to the "target." The tips of the pins may be forced into the surface surrounding the target, or by bending the legs of the pins to rest on the surrounding surface. A detonator, such as a blasting cap, may be secured to the shaped charge through an opening in the outer body, or through a clip attached to the shaped charge. The opening in the outer body is deformabale to accommodate various diameter detonators. The clip has a flange that the detonator is seated against to at ensure proper placement.

24 Claims, 7 Drawing Sheets

METHOD AND APPARATUS FOR POSITIONING A SHAPED CHARGE

FIELD OF THE INVENTION

This invention relates to shaped charges utilized for demining operations and for detonating unexploded ordnance, and more particularly, to a method and apparatus for positioning the shaped charge safely and effectively.

DETAILED DESCRIPTION OF THE INVENTION

Figure 1A:
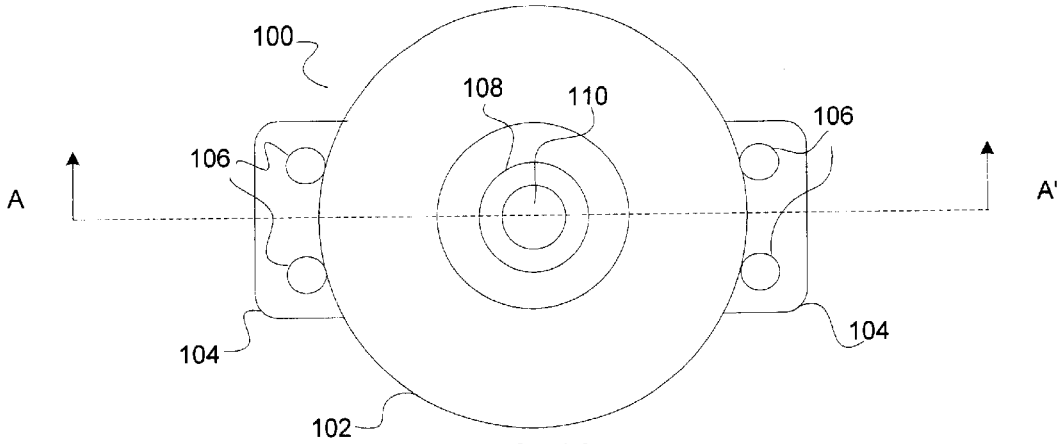
FIG. 1A shows a top view of a shaped charge utilized in an embodiment of the present invention.

FIG. 1A shows a top view of a shaped charge utilized in an embodiment of the present invention. Shaped charges have been used for many years for perforating well casings used in the oil and gas drilling industry. The use of these small precision made shape charges has recently found application in the disposal of land mines, bombs, grenades, artillery shells, and other types of hazardous unexploded ordnance found in war zones and combat training ranges. Shaped charges contain a few grams of explosive powder and are generally less than two to three inches on the maximum dimension. Through specific design, these shaped charges develop a penetrating "jet stream" which is capable of penetrating up to several inches of steel. The pressure wave and heat associated with the jet stream generate tremendous energy which is focused on the "target," and in the case of hazardous unexploded ordnance, causes a high order detonation of the ordnance. Certain shaped charges with specific design characteristics are ideally suited for short standoff applications, such as the disposal of land mines and other hazardous ordnance. Such shaped charges may be placed directly against or in very close proximity to the target. For land mines or unexploded ordnance of a sensitive nature, the shaped charge may simply be "aimed" at the target from a safe distance of a few inches or feet away, avoiding direct contact with the target. These types of shaped charges are extremely insensitive to accidental detonation. Exposure to shock, extreme cold, or extreme heat do not adversely affect their stability or performance. Training in their use is short and simple. Individuals from third world countries with little or no education can be trained to safely handle, position, arm, and detonate shaped charges utilizing the method and apparatus of the present invention.

Figure 2:
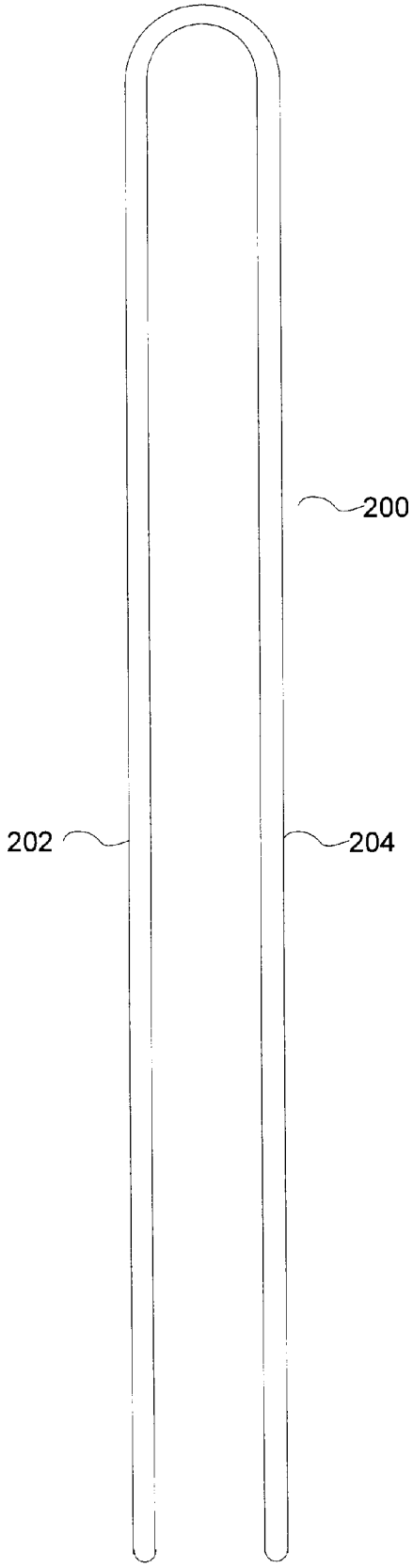
FIG. 2 shows a pin utilized with the shaped charge of FIGS. 1A, 1B, and 1C in an embodiment of the present invention.

Referring now to FIG. 1A, Shaped Charge 100 has Outer Body 102 having one or more Flanges 104. In a preferred embodiment, there are two Flanges 104 more or less positioned opposite to each other. Outer Body 102 is typically cylindrical in shape. Within each Flange 104 are one or more Flange Holes 106 for receiving a Pin 200 (FIG. 2). In a preferred embodiment, there are two Flange Holes 106 within each Flange 104. Outer Body 102 is typically made of molded rubber, but other materials may be used, such as plastic, wood, or metal. Flange Holes 106 are sized large enough to easily accommodate the insertion of Pin 200 (FIGS. 3A and 3B), but small enough such that when inserted, Pin 200 is gripped securely to Flange 104 in Outer Body 102 due to the force of friction, avoiding the need for a separate retaining means, such as a nut, cotter pin, or the like. This is most easily achieved when Outer Body 102 is made of molded rubber, where the rubber has a certain amount of elasticity, enabling Flange Holes 106 to expand to accommodate Pin 200.

Outer Body 102 has Detonator Receiving End 108 which has Opening 110. Detonator Receiving End 108 is typically cylindrical in shape. Opening 110 is designed to receive a detonating device, such as a blasting cap (not shown in FIG. 1B) which is typically also cylindrical in shape. Opening 110 is sized large enough to easily accommodate the insertion of a blasting cap, but small enough such that when inserted, the blasting cap is gripped securely to Detonator Receiving End 108 due to the force of friction. This is most easily achieved when Outer Body 102 is made of molded rubber having a certain amount of elasticity. Due to the thinness of the structure of Detonator Receiving End 108, and the elasticity of the molded rubber, Detonator Receiving End 108 can accommodate blasting caps within Opening 110 that fall within a range of different diameters.

Figure 1B:
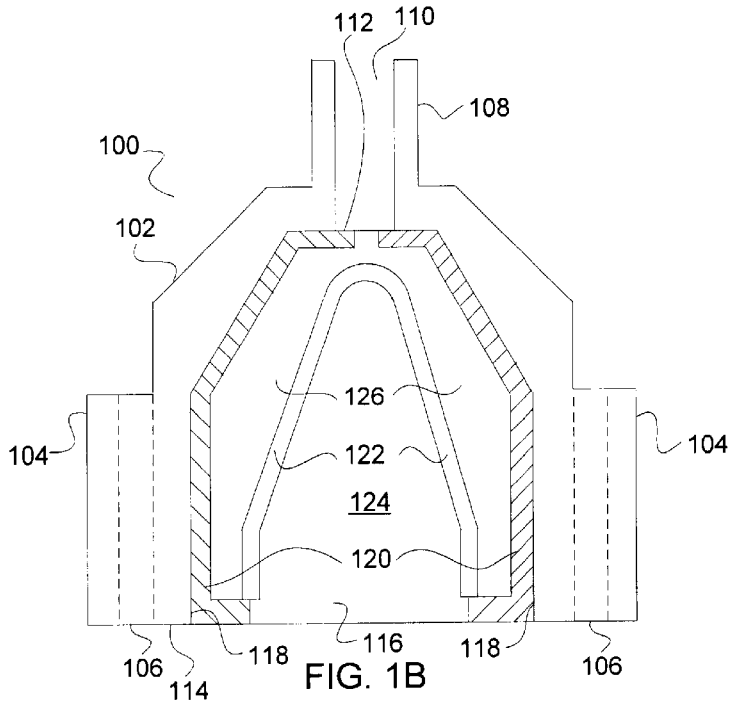
FIG. 1B shows a cross-sectional side view of the shaped charge of FIG. 1A utilized in an embodiment of the present invention.
Figure 1C:
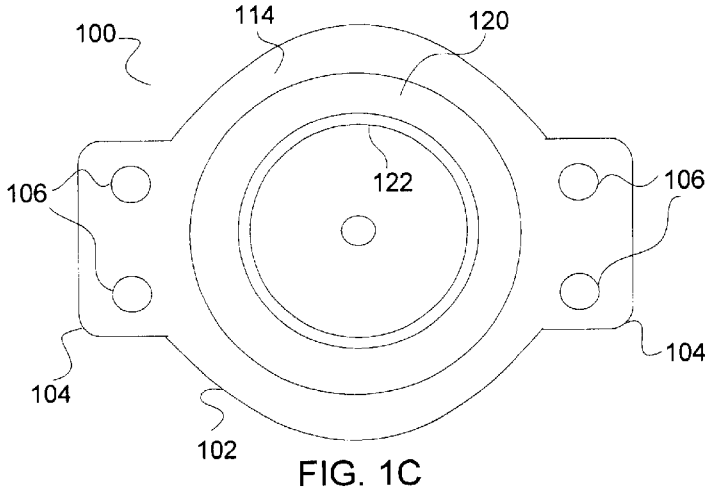
FIG. 1C shows a bottom view of the shaped charge of FIGS. 1A and 1B utilized in an embodiment of the present invention.

FIG. 1B shows a cross-sectional side view of the shaped charge of FIG. 1A utilized in an embodiment of the present invention, as seen along view plane A–A'. FIG. 1C shows a bottom view of the shaped charge of FIGS. 1A and 1B utilized in an embodiment of the present invention. Referring now to FIGS. 1B and 1C, the load end of the blasting cap is seated against Ignition Surface 112. A single shaped charge may be detonated by: direct assembly to an electric detonator, such as an M-6 electric detonator, or a commercial equivalent; direct assembly to a non-electric detonator/fuse assembly, such as an M-700/M-7 non-electric detonator/fuse assembly, or commercial equivalent; or direct assembly to blasting caps such as Non-El (non-electric) type shock tube blasting caps. Multiple shaped charges may be simultaneously detonated by: a single length of detonating cord with charges spaced at desired intervals; attaching an instantaneous electric detonator to each shaped charge and wiring the detonators in typical parallel fashion for instantaneous detonation; and, attaching an instantaneous Non-El type detonator to each shaped charge and joining the detonators in a typical fashion for instantaneous detonation.

Charge Receiving End 114 has Opening 116 which is defined by Interior Wall 118 of Outer Body 102. Casing 120 is encased by Outer Body 102, fitting securely against Interior Wall 118, and defines a Void 124 that is typically conical in shape. Charge Receiving End 114 is sized large enough to easily accommodate the insertion of Casing 120, but small enough such that when inserted, Casing 120 is gripped securely to Outer Body 102 due to the force of friction. This is most easily achieved when Outer Body 102 is made of molded rubber having a certain amount of elasticity. Casing 120 is typically made of steel. Charge Liner 122 is typically made of powdered metal, and forms a Charge Void 126 between itself and Casing 120. Charge Liner 122 is specifically designed for short standoff applications. Charge Void 126 is filled with a charge of explosive, typically RDX powder. Charge loads may vary depending on the intended target. Shaped Charges 100 of one to two inches in both length and diameter, which contain anywhere from six to twenty-two grams of explosive, are the typical range needed for most common demining and unexploded ordnance needs. Loads up to 34 grams are also available, but normally constitute "overkill." Such Shaped Charges 100 are typically classified as Hazard Class Explosive 1.4S. Packaging 100 charges per carton will yield a net explosive weight per carton of between 1½ to four pounds. Shaped charges of this nature are classified as a commercial product and are therefore not subject to international shipping restrictions placed on munitions. These shaped charges are small, lightweight, and easily and safely transported.

FIG. 2 shows a pin utilized with the shaped charge of FIGS. 1A, 1B, and 1C in an embodiment of the present invention. Referring now to FIG. 2, Pin 200 has a First Leg 202 and a Second Leg 204 of approximately equal length. Pin 200 is typically made of metal, and more particularly of a continuous piece of heavy gauge wire that is bent so as to align First Leg 202 and Second Leg 204 in a substantially parallel fashion and separated by a distance to coincide with the distance between Flange Holes 106 in Flange 104. One skilled in the art will recognize that Pin 200 could have just one leg, and that two of such type of one-leg pins could be used instead of one two-legged Pin 200. In such a case, the one-legged pin may have one end enlarged, or have a head like a nail, to keep the pin from slipping out of Flange Hole 106. One skilled in the art will also recognize that First Leg 202 and Second Leg 204 need not be of approximate equal length.

Figure 3A:
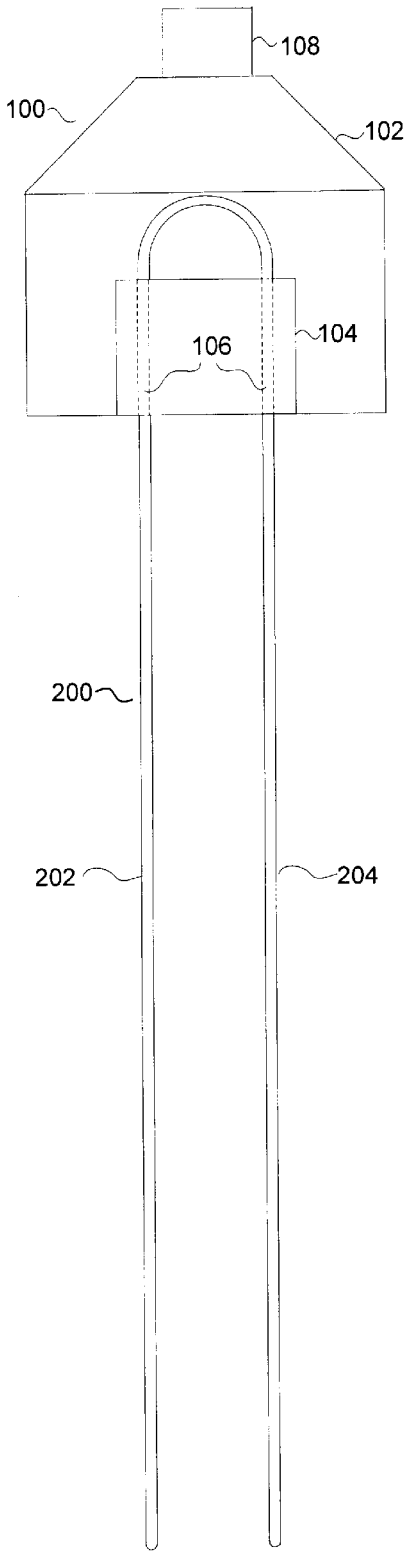
FIG. 3A shows a front view of the shaped charge of FIGS. 1A, 1B, and 1C with the inserted pins of FIG. 2 in an embodiment of the present invention.
Figure 3B:
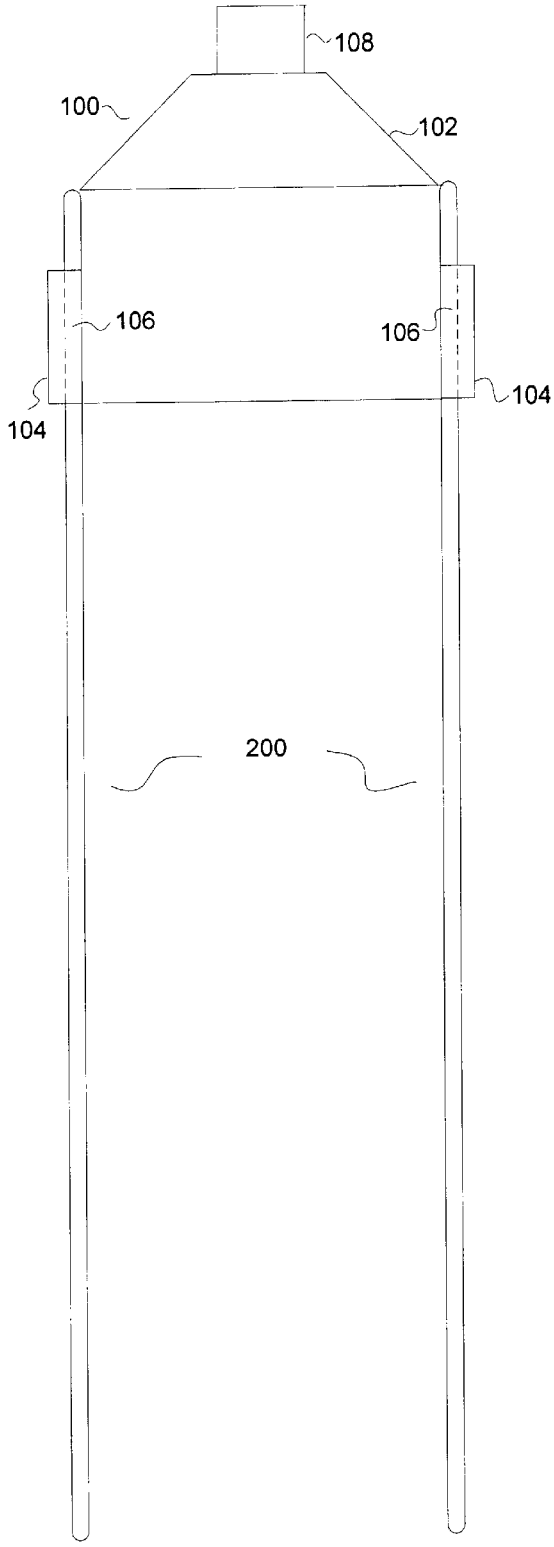
FIG. 3B shows a side view of the shaped charge of FIGS. 1A, 1B, and 1C with the inserted pins of FIG. 2 in an embodiment of the present invention.
Figure 4:
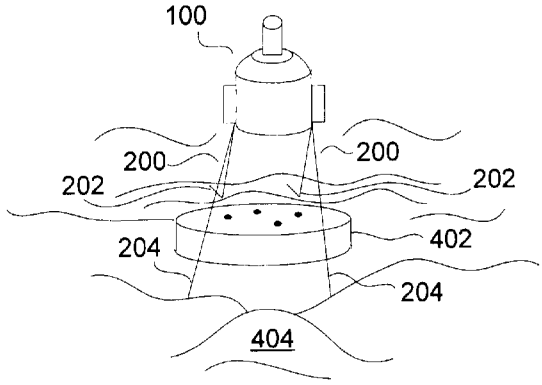
FIG. 4 shows the shaped charge with inserted pins of FIGS. 3A and 3B positioned in proximity to a land mine on an uneven and substantially rocky surface.
Figure 5:
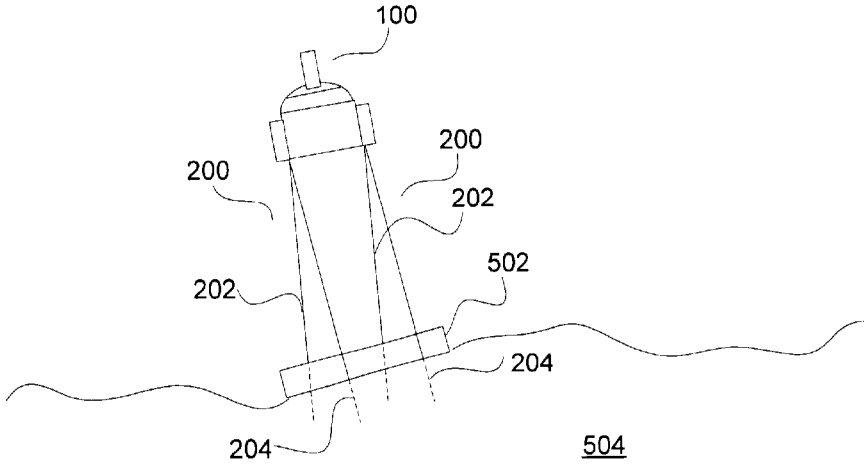
FIG. 5 shows the shaped charge with inserted pins of FIGS. 3A and 3B positioned in proximity to a land mine located on a slanted and substantially penetrable surface.
Figure 6:
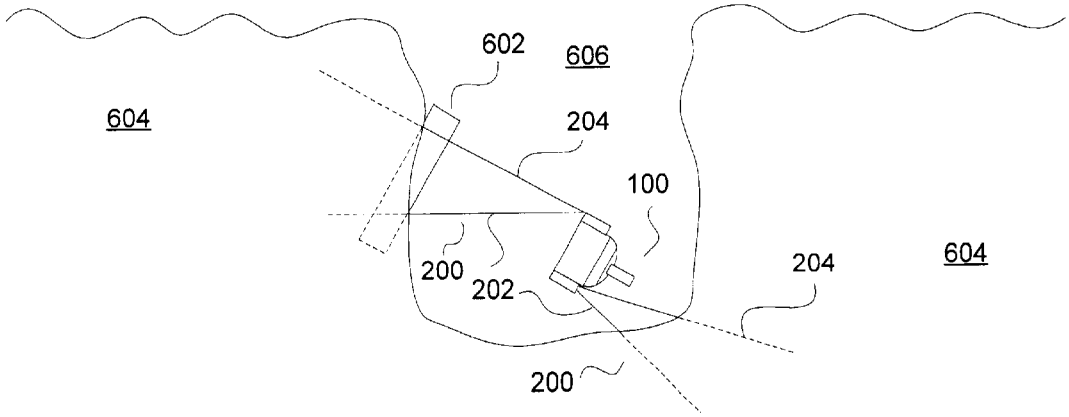
FIG. 6 shows the shaped charge with inserted pins of FIGS. 3A and 3B positioned in proximity to a land mine located in a ravine with substantially penetrable sides and bottom.

FIG. 3A shows a front view and FIG. 3B shows a side view of the shaped charge of FIGS. 1A, 1B, and 1C with the inserted pins of FIG. 2 in an embodiment of the present invention. Referring now to FIGS. 3A and 3B, Shaped Charge 100 has a Pin 200 inserted in each Flange 104 through pairs of Flange Holes 106. Each Pin 200 may be inserted in each Flange 104 to a variable distance along the length of Pin 200, but typically each Pin 200 is forced through each Flange 104 such that the majority of the length of First Leg 202 and Second Leg 204 have passed through Flange Holes 106. Depending upon the particular location and orientation of the land mine or other type of ordnance desired to be destroyed, each Pin 200 may be inserted in each Flange 104 in the opposite direction than that shown in FIGS. 3A and 3B. Additionally, one Pin 200 may be inserted in a Flange 104 in the direction shown in FIGS. 3A and 3B, and a second Pin 200 may be inserted in the other Flange 104 in the opposite direction. FIGS. 4, 5, and 6 demonstrate these alternate positions. One skilled in the art will recognize that there are many alternate ways of securing Pin 200 to Shaped Charge 100 besides Flanges 104, including, but not limited to, welding, clamping, screwing, bolting, tying, hinging, etc.

FIG. 4 shows the shaped charge with inserted pins of FIGS. 3A and 3B positioned in proximity to a land mine on an uneven and substantially rocky surface. Referring now to FIG. 4, Land Mine 402 is located on a Substantially Rocky Surface 404 such that Pins 200 may not be forced to penetrate Substantially Rocky Surface 404 to any significant degree. By manipulating First Legs 202 and Second Legs 204 a user can securely position Shaped Charge 100 for effective detonation of Land Mine 402.

In this example, First Legs 202 and Second Legs 204 are spread open and outward such that they do not touch Land Mine 402. Since Substantially Rocky Surface 404 is uneven, First Legs 202 have also been bent by the user so as to place Shaped Charge 100 in a fairly optimum position most likely to effect detonation of Land Mine 402. By manipulating the First Legs 202 of each Pin 200 in conjunction with the Second Legs 204 of each Pin 200, Shaped Charge 100 is secured in a stable position in proximity to Land Mine 402 due to the force of gravity. Shaped Charge 100 is thus positioned so that Opening 116 is directed at a portion of Land Mine 402. A blasting cap, or other detonating device described above, is placed within Detonator Receiving End 108 (not shown in FIG. 4) and connected to an electronic detonator or other detonator/fuse assembly as described above. When detonated, the jet stream will penetrate through the outer surface of Land Mine 402 causing a high order detonation of the explosive within Land Mine 402.

Previous means of detonating land mines and unexploded ordnance have several drawbacks. C-4 type explosive, which has been used for this purpose, is disadvantageous for several reasons. First, the C-4 must be placed on or nearly on the ordnance in order to be effective. It is extremely dangerous to touch or jostle land mines and unexploded ordnance. Typically about 1¼ pounds of C-4 explosive, at a cost of about $40 to $60, is required to generate enough energy to detonate a land mine. This amount of C-4 adds a significant amount of explosive to the resulting explosion, increasing the potential damage done when destroying ordnance in place, which is the safest method of destruction. In contrast, Shaped Charge 100 adds an insignificant amount of explosive material when used in the destruction of land mines and unexploded ordnance. The cost of Shaped Charge 100 is also significantly less than C-4, ranging from $4 to $7 per shaped charge. Shaped Charge 100 does not need to be placed directly on the land mine or ordnance, but may be placed a few inches or feet away. Standoff and charge position are thus significantly less critical compared to C-4, and relatively little training is needed for safe and effective use of shaped charges for this purpose. Unlike C-4, small shaped charges do not offer an attractive target for misuse or theft. Due to their configuration and relatively small explosive content, they do not readily avail themselves to terrorist or hostile use.

Other methods of detonating land mines and unexploded ordnance involve the use of specialized heavy machinery and equipment that utilizes various methods to disturb the surface of the terrain in front of the advancing machine. Protruding arms and various other devices set off the land mine or unexploded ordnance through physical disturbance. Such equipment is expensive, requires skilled operators, and is not suited for all types of terrain. The method and apparatus of the present invention is suited for all types of terrain, is very cost effective, does not require highly skilled operators, and requires very little training.

Previous attempts at using shaped charges to detonate land mines and unexploded ordnance has been problematic. Previous methods involved laying the shaped charge on the ground near the ordnance, aiming the shaped charge in the direction of the ordnance, fixing the detonator, and activating the detonator. In many cases, an optimum orientation of the shaped charge to the target could not be achieved by laying the shaped charge on the ground. In addition, because the shaped charge was not securely held in place, many times due to wind, unstable or sloping ground, movement caused by the detonator wires or cords, etc., by the time the shaped charge was detonated, it was no longer aimed in the right direction. Due to the highly directional nature of shaped charges, even slight movements may result in failure to detonate the ordnance. Also, due to the sometimes unusual locations and orientations of the ordnance when found, there often is no practical way to lay or position the shaped charge near the ordnance to effect its desired destruction.

FIG. 5 shows the shaped charge with inserted pins of FIGS. 3A and 3B positioned in proximity to a land mine located on a slanted and substantially penetrable surface. Referring now to FIG. 5, Land Mine 502 is located on a Substantially Penetrable Surface 504, such as soil, sand, or mud, such that Pins 200 may be forced to penetrate Substantially Penetrable Surface 504. Land Mine 502 may also be buried or partially buried. By manipulating First Legs 202 and Second Legs 204 a user can securely position Shaped Charge 100 for effective detonation of Land Mine 502.

In this example, First Legs 202 and Second Legs 204 are spread open and outward such that they do not touch Land Mine 502. The user has forced the tips of First Legs 202 and Second Legs 204 into Substantially Penetrable Surface 504 so as to place Shaped Charge 100 in a fairly optimum position most likely to effect detonation of Land Mine 502. By manipulating First Legs 202 and Second Legs 204 of each Pin 200 in this fashion, Shaped Charge 100 is secured in a stable position in proximity to Land Mine 502 due to the friction force acting on the tips of First Legs 202 and Second Legs 204 into Substantially Penetrable Surface 504, and the force of gravity. Shaped Charge 100 is thus positioned so that Opening 116 is directed at a portion of Land Mine 502. In many cases, only a small part of a land mine may be exposed at the surface. Bombs that don't explode upon impact may often bury themselves, leaving only a portion of the body or tail fins exposed. In such events, the user places and aims the shaped charge based on the portion of the land mine or ordnance that is exposed and the most likely orientation of the buried portion of the land mine or ordnance.

A blasting cap, or other detonating device described above is placed within Detonator Receiving End 108 (not shown in FIG. 5) and connected to an electronic detonator or other detonator/fuse assembly as described above. When detonated, the jet stream will penetrate through the outer surface of Land Mine 502 causing a high order detonation of the explosive within Land Mine 502.

FIG. 6 shows the shaped charge with inserted pins of FIGS. 3A and 3B positioned in proximity to a land mine located in a ravine with substantially penetrable sides and bottom. Referring now to FIG. 6, Land Mine 602 is located in Ravine 606 having Substantially Penetrable Sides and Bottom 604, such as soil, sand, or mud, such that Pins 200 may be forced to penetrate Substantially Penetrable Sides and Bottom 604. By manipulating First Legs 202 and Second Legs 204 a user can securely position Shaped Charge 100 for effective detonation of Land Mine 602.

In this example, Land Mine 602 is partially buried and partially exposed. First Leg 202 and Second Leg 204 of a first Pin 200 are spread open and outward such that they do not touch Land Mine 602, and a user has forced the tips of First Leg 202 and Second Leg 204 of a first Pin 200 into Substantially Penetrable Sides and Bottom 604 on the near vertical side of Ravine 606. The user has also forced the tips of First Leg 202 and Second Leg 204 of a second Pin 200, which has been inserted in Flange 104 in the opposite direction to that of first Pin 200, into Substantially Penetrable Sides and Bottom 604 on the bottom and opposite side of Ravine 606. Thus positioned by the user, Shaped Charge 100 is in the most optimum position to effect detonation of Land Mine 602. By manipulating First Legs 202 and Second Legs 204 of each Pin 200 in this fashion, Shaped Charge 100 is secured in a stable position in proximity to Land Mine 602 due to the friction force acting on the tips of First Legs 202 and Second Legs 204 into Substantially Penetrable Sides and Bottom 604, despite the force of gravity. Shaped Charge 100 is thus positioned so that Opening 116 is directed at a portion of Land Mine 602. A blasting cap, or other detonating device described above is placed within Detonator Receiving End 108 (not shown in FIG. 6) and connected to an electronic detonator or other detonator/fuse assembly as described above. When detonated, the jet stream will penetrate through the outer surface of Land Mine 602 causing a high order detonation of the explosive within Land Mine 602.

One skilled in the art will recognize that one or more Pins 200 inserted into a Shaped Charge 100 as shown in FIGS. 3A and 3B may be bent, spread, and otherwise manipulated in an infinite number of ways in order to securely position Shaped Charge 100 near a target. The above Figures and discussion are merely exemplary of the types of situations encountered in the field, and are not meant to be limiting. In some situations, the legs of Pins 200 may be wrapped around structures or debris near a target where the structures or debris may not be safely removed for fear of setting off the target. In some situations, only one one-legged pin may be needed to optimally position Shaped Charge 100 in proximity to a target. In other situations, one two-legged Pin 200 may be sufficient, or one one-legged pin and one two-legged Pin 200, or three one-legged pins, or two two-legged Pins 200, etc. Also, two Pins 200 may be placed in one Flange 104 by placing only a First Leg 202 from each Pin 200 in Flange Holes 206, and the same for the second Flange 104, thus having four Pins 200 attached to Outer Body 102.

In some cases, the ordnance to be destroyed may have been found using a metal detector or other finding device and is completely buried underground. Once the location has been determined, and the depth has been determined to be within a range suitable for utilizing Shaped Charge 100, Shaped Charge 100 with one or more Pins 200 may be positioned securely in proximity to the buried ordnance and detonated to effect its destruction. One skilled in the art will also recognize that the method and apparatus for positioning a shaped charge of the present invention is not limited to destroying land mines and other unexploded ordnance, but may be applied to any situation practicable where a shaped charge needs to be securely positioned before detonation.

Figure 7:
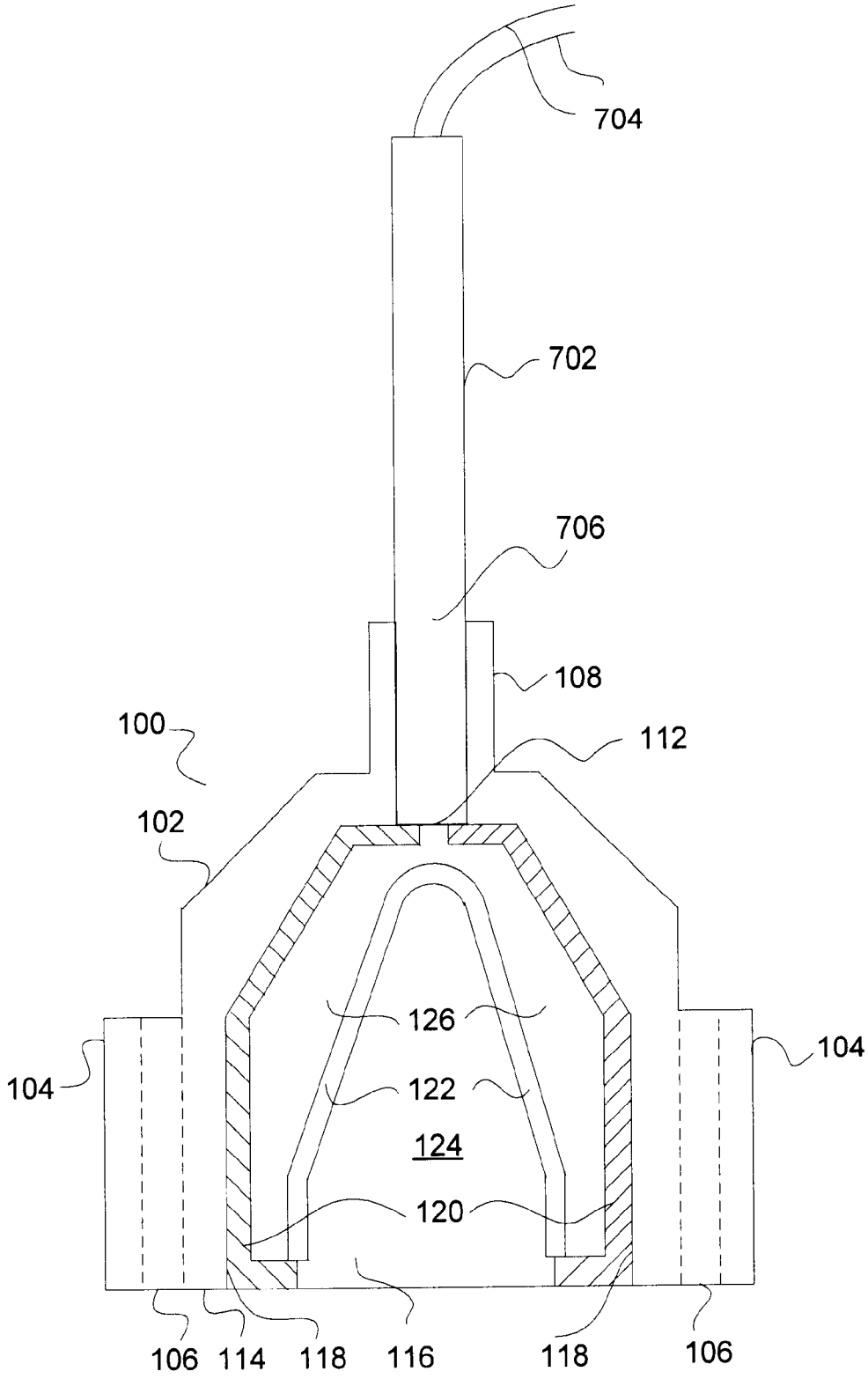
FIG. 7 shows an electric blasting cap inserted in the shaped charge of FIG. 1B in an embodiment of the present invention.

FIG. 7 shows an electric blasting cap inserted in the shaped charge of FIG. 1B in an embodiment of the present invention. Referring now to FIG. 7, Shaped Charge 100 is shown in a cross-sectional view as in FIG. 1B. Electric Blasting Cap 702 (not shown in cross-section) has been inserted in Opening 110 of Detonator Receiving End 108. Other types of detonators as described above may also be used. Load End 706 of Electric Blasting Cap 702 is seated against Ignition Surface 112 of Casing 120. Electric Blasting Cap 702 is gripped securely to Detonator Receiving End 108 due to the force of friction between Load End 706 and the interior surface of Detonator Receiving End 108. Larger diameter detonators than the one shown in FIG. 7 when inserted in Detonator Receiving End 108 will deform Detonator Receiving End 108 outward due to the elasticity of the material forming the structure of Detonator Receiving End 108.

Insulated Electric Wires 704 are connected into a circuit (not shown in FIG. 7). When Electric Blasting Cap 702 is detonated, the explosion ignites the RDX powder in Charge Void 126.

Figure 8A:
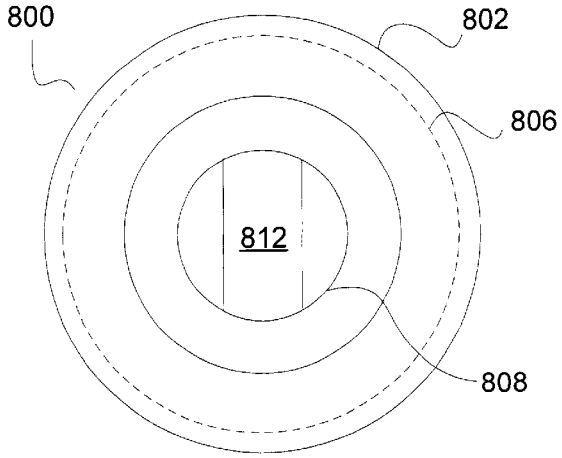
FIG. 8A shows a top view of a shaped charge utilized in an embodiment of the present invention.
Figure 8B:
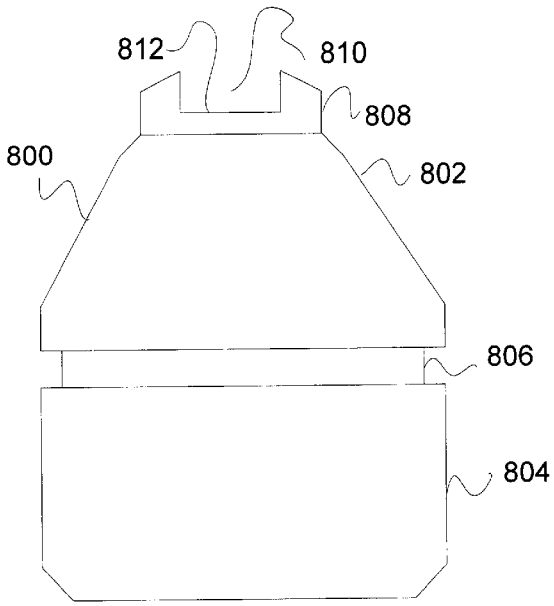
FIG. 8B shows a side view of the shaped charge of FIG. 8A utilized in an embodiment of the present invention.

FIG. 8A shows a top view and FIG. 8B shows a side view of a if shaped charge utilized in an embodiment of the present invention. Referring now to FIGS. 8A and 8B, Shaped Charge 800 has an Upper Casing 802 and a Lower Casing 804 connected by an Indent 806. Cap 808 is formed on Upper Casing 802 and defines a Channel 810 therein. Shaped Charge 800 is typically cylindrical in shape and is typically made of steel. The load end of a blasting cap is seated against Ignition Surface 812 and held in place with the aid of the clip described below in FIGS. 9A and 9B. Lower Casing 804 may have an outer body with flanges (not shown in FIGS. 8A and 8B) similar to Outer Body 102 and Flanges 104 (FIG. 1) but not extending over Indent 806 or Upper Casing 802 and lacking Detonator Receiving End 108. Pins 200 (FIG. 2) may then be used as described above to position Shaped Charge 800 in proximity to a target.

Figure 9A:
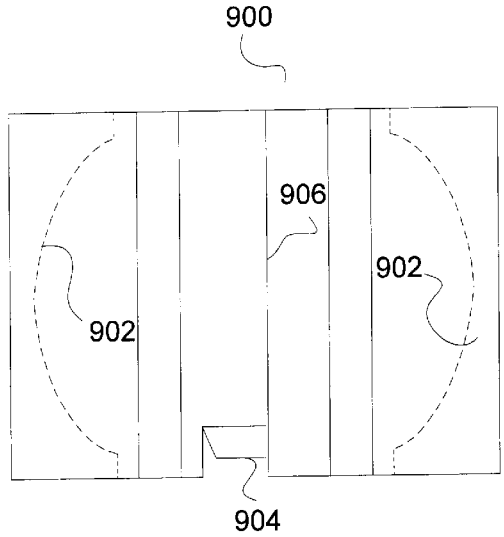
FIG. 9A shows a top view of a clip utilized with the shaped charge of FIGS. 8A and 8B in an embodiment of the present invention.
Figure 9B:
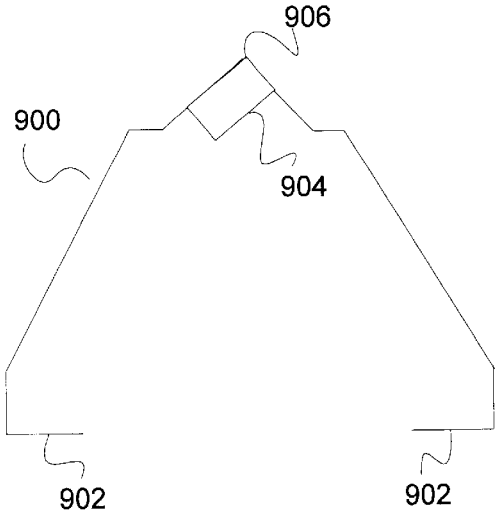
FIG. 9B shows a side view of the clip of FIG. 9A utilized with the shaped charge of FIGS. 8A and 8B utilized in an embodiment of the present invention.
Figure 10A:
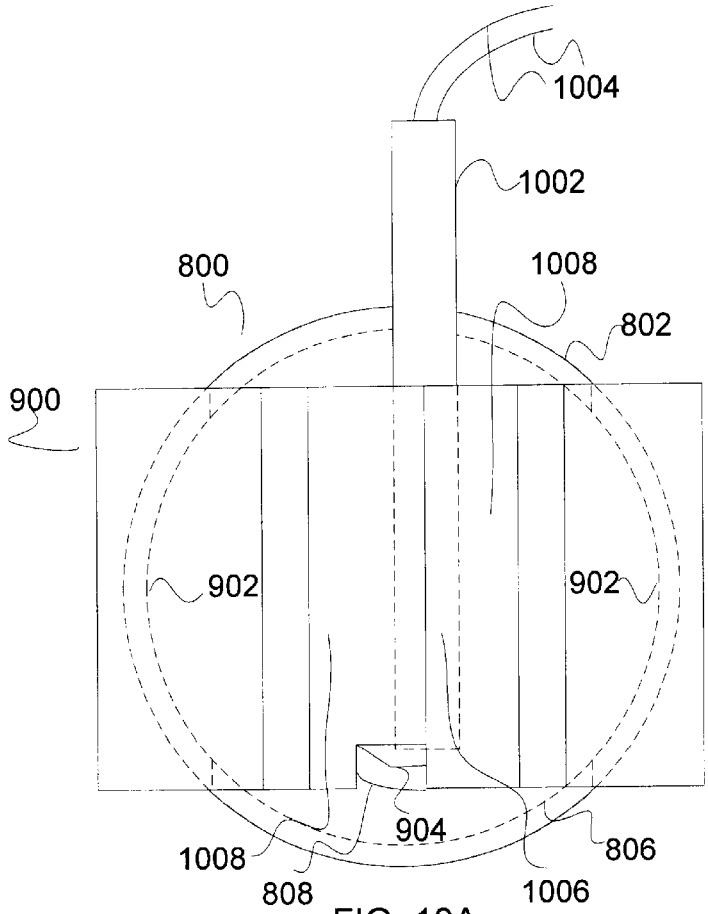
FIG. 10A shows a top view of the clip of FIGS. 9A and 9B attached to the shaped charge of FIGS. 8A and 8B with a blasting cap seated in place in an embodiment of the present invention.
Figure 10B:
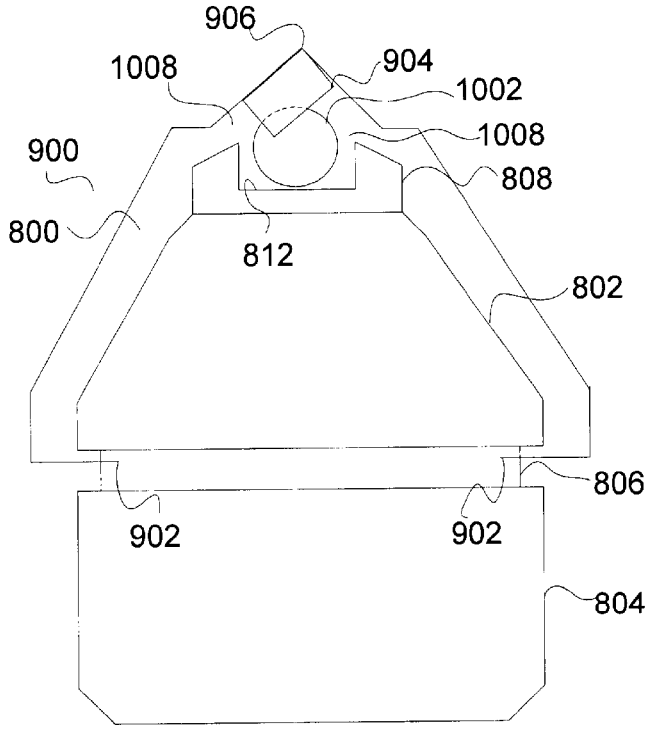
FIG. 10B shows a side view of the clip of FIGS. 9A and 9B attached to the shaped charge of FIGS. 8A and 8B with a blasting cap seated in place utilized in an embodiment of the present invention.

FIG. 9A shows a top view and FIG. 9B shows a side view of a clip utilized with the shaped charge of FIGS. 8A and 8B in an embodiment of the present invention. Referring now to FIGS. 9A and 9B, Clip 900 is typically made of tempered steel, making it very rigid yet having a spring-like quality, but other materials with similar properties, such as certain plastics, may also be used. Clip 900 has several folds or bends to create a shape that is cooperative with Upper Casing 802 and Indent 806. Tabs 902 are rounded inward, and are designed to fit in Indent 806 with the concave portion matching the curvature of Indent 806, making a snug fit as shown in FIGS. 10A and 10B. Flange 904 is notched out of Ridge Portion 906 of Clip 900 and is bent toward Tabs 902.

FIG. 10A shows a top view of the clip of FIGS. 9A and 9B attached to the shaped charge of FIGS. 8A and 8B, and FIG. 10B shows a side view of the clip of FIGS. 9A and 9B attached to the shaped charge of FIGS. 8A and 8B, with a blasting cap seated in place in an embodiment of the present invention. Referring now to FIGS. 10A and 10B, Clip 900 has been positioned on Shaped Charge 800 and aligned such that Ridge Portion 906 is parallel to a long dimension of Channel 810. This may be accomplished by forcing Clip 900 down on Upper Casing 802 causing Tabs 902 to move away from each other as they slide down the surface of Upper Casing 802 until the Tabs 902 snap into Indent 806, and then rotating Clip 900 until Ridge Portion 906 is parallel to a long dimension of Channel 810. Clip 900 may also be positioned on Shape Charge 800 by grasping Tabs 902 and pulling them away from each other, bringing Clip 900 down on Shaped Charge 800 until Tabs 902 align with Indent 806, and then releasing Tabs 902 to snap into place in Indent 806. Clip 900 is then rotated until Ridge Portion 906 is parallel to a long dimension of Channel 810.

Once in this position, Channel 810 and Ridge Portion 906 define a Void 1008 there between for receiving a detonation device, such as Electric Blasting Cap 1002. Load End 1006 of Electric Blasting Cap 1002 is seated against Flange 904 and between Ignition Surface 812 of Cap 808 and Ridge Portion 906. Seating Load End 1006 against Flange 904 positions Electric Blasting Cap 1002 in the proper position for detonating Shaped Charge 800. Without Clip 900, users often misplace Electric Blasting Cap 1002 by centering it in Channel 810 such that Load End 1006 is not aligned with Ignition Surface 812. When Electric Blasting Cap 1002 is detonated in this position, Shaped Charge 800 is not detonated. Clip 900 ensures that the Load End 1006 of Electric Blasting Cap 1002 is properly aligned with Ignition Surface 812.

Insulated Electric Wires 1004 extending from Electric Blasting Cap 1002 are connected into a circuit (not shown in FIG. 10A) for ignition. Flange 904 serves as a limit such that when Load End 1006 is inserted in Void 1008 by the user, Load End 1006 seats against Flange 904 and no further, leaving Insulated Electric Wires 1004 extending and unobstructed from Void 1008.

Having described the present invention, it will be understood by those skilled in the art that many changes in construction and widely differing embodiments and applications of the invention will suggest themselves without departing from the scope of the present invention.

What is claimed is:

1. An apparatus for positioning a shaped charge in proximity to a target, the apparatus comprising:

an outer body encasing the shaped charge;

at least one flange located on said outer body wherein said at least one flange defines at least one hole there through;

at least one pin having at least one leg, wherein said at least one leg of said at least one pin is inserted in said at least one hole defined by said at least one flange, wherein said at least one leg of said at least one pin is manipulated to securely position the shaped charge in proximity to the target, and further wherein said at least one pin is made of a heavy gauge wire which is manipulable to securely position the shaped charge in proximity to the target.

2. A method for positioning a shaped charge in proximity to a target, the method comprising:

(a) securing at least one pin to the shaped charge;

(b) manipulating at least one leg of said at least one pin to securely position the shaped charge in proximity to the target;

(c) encasing the shaped charge in an outer body defining an opening for receiving the shaped charge; and (d) inserting said at least one leg of said at least one pin in at least one flange of said outer body encasing the shaped charge, wherein said at least one flange defines at least one hole there through for receiving said at least one leg.

3. A method according to claim 2 wherein said outer body is made of molded rubber, and said opening defined by said outer body is sized such that when encased, the shaped charge is gripped securely by said outer body.

4. A method for positioning a shaped charge in proximity to a target, the method comprising:

(a) securing at least one pin to the shaped charge;

(b) encasing the shaped charge in an outer body defining an opening for receiving the shaped charge;

(c) inserting at least one leg of said at least one pin in at least one flange of said outer body encasing the shaped charge, wherein said at least one flange defines at least one hole there through for receiving said at least one leg, and further wherein said at least one flange is made of molded rubber, and said at least one hole defined in said at least one flange is sized such that when inserted, said at least one leg of said at least one pin is gripped securely by said at least one flange; and (d) manipulating one of said at least one leg of said at least one pin to securely position the shaped charge in proximity to the target.

5. A method according to claim 4 further comprising:

inserting a detonating device in an opening in a receiving end of said outer body.

6. A method according to claim 5 further comprising:

seating a load end of said detonating device against an ignition surface of the shaped charge.

7. A method according to claim 5 wherein said opening in said receiving end is sized such that when said detonating device is inserted in said opening and said load end is seated against said ignition surface, said detonating device is gripped securely to said receiving end.

8. A method according to claim 4 wherein said manipulating step further comprises:

bending said at least one leg of said at least one pin to rest on a surface adjacent to the target.

9. A method according to claim 4 wherein said manipulating step further comprises:

inserting said at least one leg of said at least one pin into a surface adjacent to the target.

10. A method according to claim 4 wherein the target is a land mine.

11. A method according to claim 4 wherein the target is an unexploded ordnance.

12. A method for positioning a shaped charge in proximity to a target, the method comprising:

(a) securing at least one pin to the shaped charge;

(b) manipulating at least one leg of said at least one pin to securely position the shaped charge in proximity to the target;

(c) attaching a clip to the shaped charge by snapping at least one tab of said clip into an indent of the shaped charge, wherein said clip has a ridge portion having a flange notched out there from;

(d) inserting a detonating device in a void defined by said ridge portion of said clip and a cap defining a channel therein on an upper portion of the shaped charge; and (e) seating a load end of said detonating device against said flange and against an igniting surface of said channel of said cap.

13. A method according to claim 12 wherein said clip is made of tempered steel.

14. An apparatus for positioning a shaped charge in proximity to a target, the apparatus comprising:

an outer body encasing the shaped charge, said outer body further comprising a receiving end having an opening defined therein, wherein a load end of a detonating device is inserted in said opening and seated against an igniting surface of the shaped charge, and further wherein said opening in said receiving end is sized such that when said detonating device is inserted in said opening, said detonating device is gripped securely to said receiving end;

at least one flange located on said outer body wherein said at least one flange defines at least one hole there through; and at least one pin having at least one leg, wherein said at least one leg of said at least one pin is inserted in said at least one hole defined by said at least one flange, wherein said at least one leg of said at least one pin is manipulated to securely position the shaped charge in proximity to the target.

15. An apparatus for positioning a shaped charge in proximity to a target, the apparatus comprising:

an outer body encasing the shaped charge, wherein said outer body is made of molded rubber and defines an opening for receiving the shaped charge, wherein said opening defined by said outer body is sized such that when encased in said outer body, the shaped charge is gripped securely by said outer body;

at least one flange located on said outer body wherein said at least one flange defines at least one hole there through; and at least one pin having at least one leg, wherein said at least one leg of said at least one pin is inserted in said at least one hole defined by said at least one flange, wherein said at least one leg of said at least one pin is manipulated to securely position the shaped charge in proximity to the target.

16. The apparatus according to claim 15 wherein said at least one flange is made of molded rubber, and said at least one hole defined by said at least one flange is sized such that when inserted, said at least one leg of said at least one pin is gripped securely by said at least one flange.

17. The apparatus according to claim 1 wherein the target is a land mine.

18. An apparatus for positioning a shaped charge in proximity to a target, the apparatus comprising:

an outer body encasing the shaped charge;

at least one flange located on said outer body wherein said at least one flange defines at least one hole there through;

at least one pin having at least one leg, wherein said at least one leg of said at least one pin is inserted in said at least one hole defined by said at least one flange, wherein said at least one leg of said at least one pin is manipulated to securely position the shaped charge in proximity to the target, and further wherein said at least one flange defines a first hole and a second hole there through, wherein said first hole and said second hole are separated by a first distance, and further wherein said at least one pin has a first leg and a second leg joined at one end such that said first leg and said second leg are aligned substantially parallel to each other and separated from each other by said first distance.

19. The apparatus according to claim 18 wherein a first one-legged pin is inserted in said first hole and a second one-legged pin is inserted in said second hole of said at least one flange.

20. The apparatus according to claim 18 wherein said outer body has at least two flanges, wherein each of said at least two flanges defines said first hole and said second hole there through.

21. The apparatus according to claim 1 wherein the target is an unexploded ordnance.

22. An apparatus for positioning a shaped charge in proximity to a target, the apparatus comprising:

an outer body encasing the shaped charge;

at least one flange located on said outer body wherein said at least one flange defines at least one hole there through;

at least one pin having at least one leg, wherein said at least one leg of said at least one pin is inserted in said at least one hole defined by said at least one flange, wherein said at least one leg of said at least one pin is manipulated to securely position the shaped charge in proximity to the target; and a clip having a at least one tab for snapping into an indent on the shaped charge and having a ridge portion having a flange notched out there from, wherein when said clip is snapped in place on the shaped charge, said clip defines a void between said ridge portion of said clip and the shaped charge.

23. The apparatus according to claim 22 further comprising:

a detonating device inserted in said void defined by said ridge portion of said clip and a cap defining a channel therein on an upper portion of the shaped charge, wherein a load end of said detonating device is seated against said flange and against an igniting surface of said channel of said cap.

24. The apparatus according to claim 22 wherein said clip is made of tempered steel.

* * * * *